US008042511B2

(12) United States Patent
Naegele et al.

(10) Patent No.: US 8,042,511 B2
(45) Date of Patent: Oct. 25, 2011

(54) METHOD AND DEVICE FOR PRIMING A FUEL METERING DEVICE

(75) Inventors: Claus Naegele, Stuttgart (DE); Wolfgang Layher, Besigheim (DE); Arno Kinnen, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 13 days.

(21) Appl. No.: 12/576,468

(22) Filed: Oct. 9, 2009

(65) Prior Publication Data

US 2010/0101523 A1 Apr. 29, 2010

(30) Foreign Application Priority Data

Oct. 29, 2008 (DE) ..... 10 2008 053 808

(51) Int. Cl.
*F02M 1/16* (2006.01)

(52) U.S. Cl. ..... 123/179.12; 123/179.9; 123/DIG. 5

(58) Field of Classification Search ..... 123/179.9, 123/179.12, DIG. 5
See application file for complete search history.

(56) References Cited

U.S. PATENT DOCUMENTS 4,159,012 A * 6/1979 Pizzuto et al. ..... 123/65 R
4,542,726 A 9/1985 Baltz et al.
4,848,290 A * 7/1989 Miller ..... 123/179.13
5,009,211 A * 4/1991 Kushida et al. ..... 123/491
5,408,975 A * 4/1995 Blakeslee et al. ..... 123/491
5,454,359 A * 10/1995 Howell ..... 123/516
5,927,253 A * 7/1999 Oyafuso et al. ..... 123/456
6,817,343 B1 * 11/2004 Greco et al. ..... 123/497
6,915,772 B2 * 7/2005 Carpenter ..... 123/179.12
7,093,576 B2 * 8/2006 DeRaad ..... 123/179.17
7,140,352 B2 * 11/2006 Nickel et al. ..... 123/438
7,267,326 B2 * 9/2007 Dedering ..... 261/35
2006/0185632 A1 * 8/2006 Mavinahally ..... 123/73 V
2006/0243251 A1 11/2006 Nickel et al.
2008/0264388 A1 10/2008 Rosskamp et al.

FOREIGN PATENT DOCUMENTS

EP 1719902 A 11/2008

* cited by examiner

*Primary Examiner* — Mahmoud Gimie
*Assistant Examiner* — David Hamaoui
(74) *Attorney, Agent, or Firm* — Gudrun E. Huckett

(57) ABSTRACT

In a method for priming a fuel metering device for an internal combustion engine with a piston arranged in a combustion chamber and driving a crankshaft that is rotatably supported in a crankcase, with a fuel pump that conveys fuel from a fuel tank to a metering valve that opens into a metering chamber at alternating operating pressure, and with a control unit that calculates and controls timing for the metering valve for metering a fuel quantity corresponding to a load situation of the internal combustion engine, the metering valve is kept open, independent of the calculated timing for the metering valve, for a priming duration in a starting phase of the internal combustion engine when the alternating operating pressure of the metering chamber at the mouth of the metering valve is negative and when a fuel system pressure in the fuel metering device is below a target pressure.

12 Claims, 3 Drawing Sheets

METHOD AND DEVICE FOR PRIMING A FUEL METERING DEVICE

BACKGROUND OF THE INVENTION

The invention concerns a method for priming a fuel metering device for a two-stroke engine comprising at least one piston arranged in a combustion chamber that drives by means of a connecting rod a crankshaft that is rotatably supported in a crankcase, comprising a fuel pump that sucks in fuel from a fuel tank and conveys it to a metering valve that opens into a metering chamber at alternating operating pressure, and comprising a control unit for calculating and controlling the timing for the metering valve for the purpose of metering a fuel quantity corresponding to a load situation of the internal combustion engine.

The invention also relates to a fuel metering device for an internal combustion engine comprising at least one piston arranged in a combustion chamber that drives by means of a connecting rod a crankshaft that is rotatably supported in a crankcase, comprising a fuel pump that sucks in fuel from a fuel tank and conveys it to a metering valve that opens into a metering chamber at alternating operating pressure, and comprising a control unit for calculating and controlling the timing for the metering element for the purpose of metering a fuel quantity corresponding to a load situation of the internal combustion engine.

Fuel metering devices in the form of injection devices are known. For disturbance-free function it must be ensured that the system is free of air. In particular in low-pressure injection systems or in low-pressure fuel supply systems air inclusions cause significant disruptions, in particular when fuel pumps are used that cannot convey air bubbles on their own.

In case of hand-held power tools such as motor chainsaws, trimmers, cut-off machines or the like, two-stroke engines are used as a drive means whose fuel metering devices comprise a fuel pump that is configured as a diaphragm pump and is driven by the fluctuating crankcase pressure of the internal combustion engine. When air bubbles have formed in the pump chamber of the diaphragm pump, the conveying quantity is greatly limited so that particularly when starting an internal combustion engine significant starting problems may be caused. Therefore, so-called purgers are proposed that are operated like a hand pump and must be actuated by the user in order to prime the fuel system. Such hand pumps—purgers—must be additionally mounted and connected to the fuel system. Only once sufficient fuel is present in the pump chamber of the diaphragm pump, its conveying action begins wherein a low-pressure level up to approximately 1 bar is reached.

SUMMARY OF THE INVENTION

The invention has the object to configure a fuel metering device of the aforementioned kind in such a way that in the starting phase an effective priming of the fuel metering device is realized.

The object is solved according to the present invention in that a starting phase of the internal combustion engine the metering valve, independent of calculated control times, is maintained open for a priming duration when the operating pressure of the metering chamber that exists at the mouth of the metering valve is negative and the fuel system pressure in the fuel metering device is below a target pressure.

Since in the starting phase of the internal combustion engine the metering valve, independent of the calculated control timing, is kept open for a priming duration, the negative operating pressure of the metering chamber that exists at the mouth of the metering valve can exert a suction effect wherein at this point in time the system pressure in the fuel supply conduit to the metering valve is approximately at ambient pressure.

The priming duration is chosen such that for priming of the fuel system there is always an underpressure acting for which reason in the starting phase the metering valve is closed at the latest when the alternating operating pressure of the metering chamber has reached a minimum. In this case, a maximum underpressure is utilized.

Moreover, when the metering valve is opened for a priming duration only when the alternating operating pressure of the metering chamber is below the system pressure in the fuel metering system, the underpressure will not be reduced when opening the valve again for a further priming duration.

In an advantageous way, the priming duration is set to begin at a negative pressure course and end at a minimum of the pressure course of the alternating operating pressure. The alternating operating pressure can be the alternating crankcase pressure in the crankcase but also the fluctuating intake underpressure in the intake passage or in the transfer passage.

In order to enable in the starting phase a control of the metering valve without further additional sensors, it is provided to make the timing of the priming duration of the metering valve for priming the fuel metering device dependent on the crankcase position.

Advantageously, the starting phase of the fuel metering device is terminated after a predetermined number of crankcase revolutions. This criterion can be easily applied with the existing means without additional expenditure. For example, the number of crankcase revolutions can be acquired easily and, for example, after approximately 25 crankcase revolutions, the starting phase can be terminated. Advantageously, the number of crankcase revolutions is approximately between 10 and 50.

In a simple way, a termination of the starting phase of the fuel metering device after onset of combustion is possible.

Whether a starting phase is even required can be determined by measuring a component temperature, for example, the cylinder temperature. Above a limit temperature the starting phase of the fuel metering device is blocked because it can be assumed that as a result of a recent operating period the fuel metering device is still primed.

A fuel metering device for performing the method according to the present invention is characterized in that a start control device is provided that in a starting phase of the internal combustion engine keeps open the metering valve, independent of the timing calculated by the control unit, for a priming duration when the alternating operating pressure of the metering chamber that exists at the mouth of the metering valve is negative and the fuel system pressure in the fuel supply line to the metering valve is below a target pressure.

In addition to the control unit for calculating and controlling the timing of the metering element during the operation of the internal combustion engine, for the starting phase of the internal combustion engine a start control device is provided that keeps open the metering valve for the priming duration, independent of the control timing calculated by the control unit. During the priming duration the alternating operating pressure of the metering chamber that exists at the mouth of the metering valve is negative, wherein the system pressure in the fuel supply line to the metering valve is below normal pressure.

The fuel pump in the fuel metering device is expediently a diaphragm pump that is driven by the fluctuating crankcase inner pressure.

The start control device can be designed such that it overrides only for a predetermined number of crankcase revolutions the control unit of the metering valve.

BRIEF DESCRIPTION OF THE DRAWINGS

Further features of the invention result from the additional claims, the description, and the drawing in which in the following an embodiment of the invention will be described in more detail.

DESCRIPTION OF PREFERRED EMBODIMENTS

Figure 1:
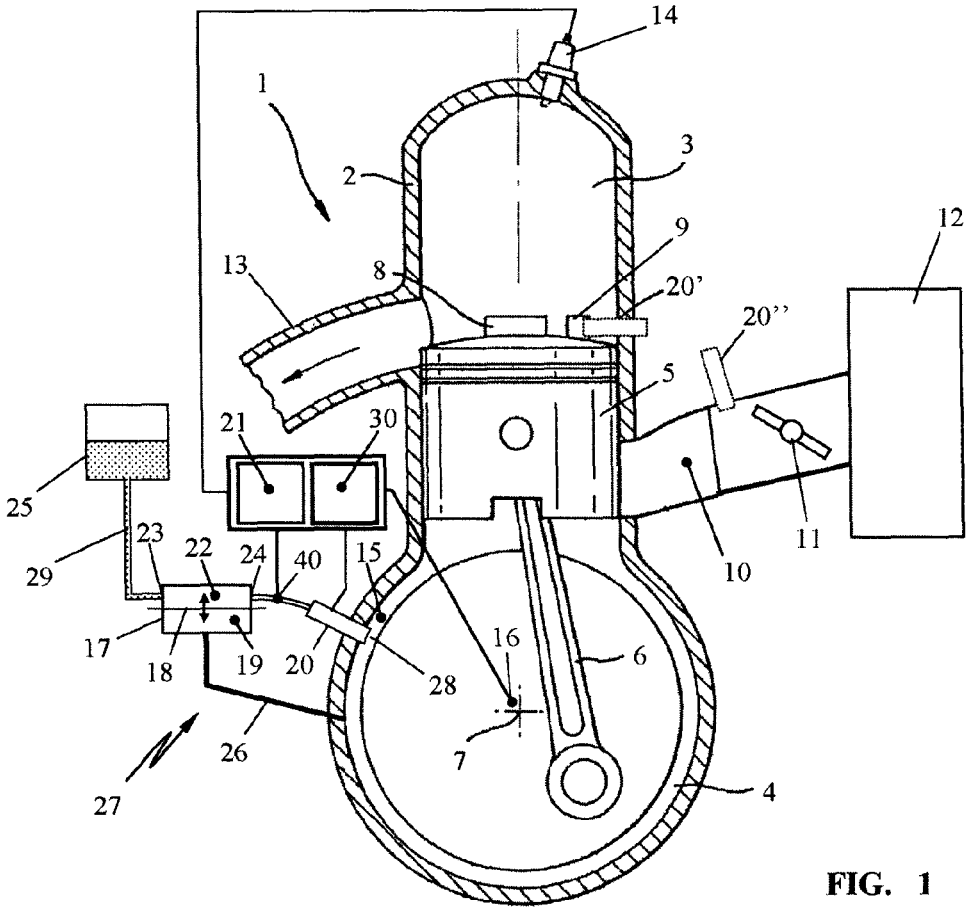
FIG. 1 shows in schematic illustration an internal combustion engine exemplified by a single-cylinder two-stroke engine with fuel metering device.

The internal combustion engine 1 illustrated in FIG. 1 is representative generally for a single-cylinder or multi-cylinder internal combustion engine that can be operated by a two-stroke or four-stroke process. In the embodiment a two-stroke engine, in particular, a single-cylinder two-stroke engine is illustrated that comprises a piston 5 that delimits a combustion chamber 3. The combustion chamber 3 is configured within the cylinder 2 and has transfer passages 8 and 9 that connect a crankcase 4 with the combustion chamber 3. Transfer of a mixture from the crankcase 4 through the transfer passages 8 and 9 into the combustion chamber 3 is controlled by the piston 5 with port timing.

The piston 5 drives by means of a connecting rod 6 a crankshaft 7 that is supported rotatably in the crankcase 4.

At the bottom of the cylinder 2, an intake passage 10—also controlled by the piston 5 with port timing—is provided that by means of an air metering device 11 (throttle valve) supplies the required combustion air for operation of the internal combustion engine. The combustion air is purified before entering the intake passage 10 by means of an air filter 12.

The intake passage 10 has positioned opposite thereto at the bottom of the cylinder 2 an exhaust gas outlet 13 that is also controlled by the piston 5 with port timing.

For the operation of the internal combustion engine 1 a fuel air mixture is to be supplied to the combustion chamber 3. In the illustrated embodiment according to FIG. 1—a single-cylinder two-stroke engine—the combustion air is taken in through the intake passage 10 into the crankcase 4 and the required fuel quantity is supplied by a metering valve 20 to the crankcase 4. As shown in FIG. 1, the metering valve 20' can also open into a transfer passage 9 or the metering valve 20" can dispense the fuel also directly into the incoming combustion air at the intake passage 10.

In operation of the internal combustion engine, by means of a control unit 21 the fuel quantity is calculated that is to be supplied in accordance with the determined load situation of the internal combustion engine. The fuel quantity is metered in by valve timing of the metering valve 20 wherein the introduction of the fuel into the metering chamber 15 is carried out in those time periods in which the alternating operating pressure in the metering chamber 15 is below the system pressure SB in the fuel metering system. The control unit 21 controls also the ignition of a spark plug 14 as a function of the rotation angle position of the crankcase 7. For this purpose, an angle sensor 16 or incremental transducer is connected to the control unit 21 so that the control unit 21 recognizes the momentary rotation position of the crankcase 7.

The metering valve 20 is supplied by a fuel pump 17 that is provided as the only fuel pump in the fuel metering device and, in the illustrated embodiment, is embodied as a diaphragm pump. A working diaphragm 18 separates a working chamber 19 loaded by the crankcase pressure from a pump chamber 22 wherein the pump chamber 22 by means of a supply valve 23 is connected to a fuel tank 25 and by means of a drain valve 24 to the metering valve 20. Expediently the system is connected to a pressure reservoir, not illustrated, that is arranged advantageously on the pressure side, independent of the kind of employed pump.

The alternating crankcase pressure in the crankcase 4 is supplied by connecting conduit 26 to the working chamber 19 of the diaphragm pump 17 so that the working diaphragm 18 moves up and down in the direction of the double arrows. In this way, in the pump chamber 22 a conveying action of fuel from the tank 25 to the metering valve 20 is achieved, inasmuch as the pump chamber 22 is primed sufficiently with fuel to generate a conveying pressure of maximally approximately 1 bar.

Figure 2:
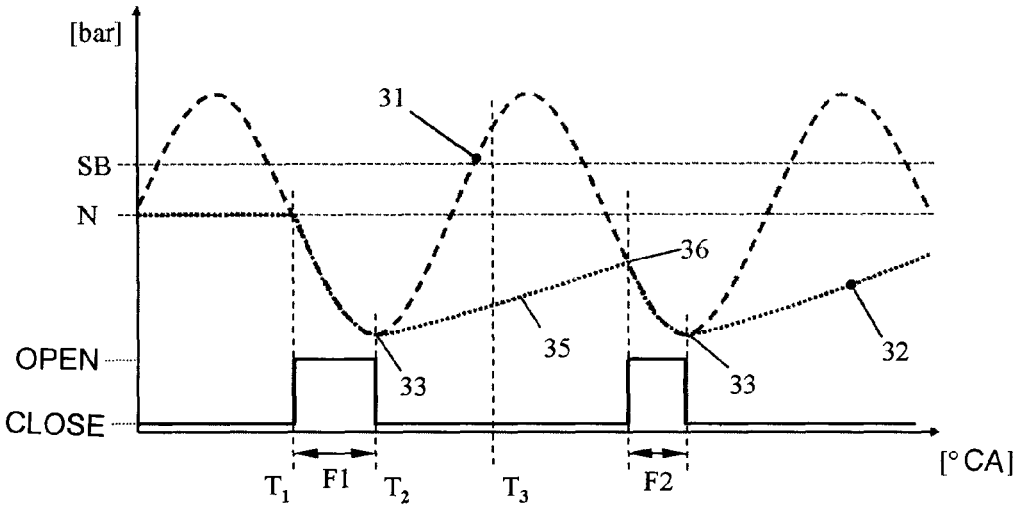
FIG. 2 illustrates pressure courses of the fuel system pressure and of a fluctuating operating pressure plotted against the crank angle.
Figure 3:
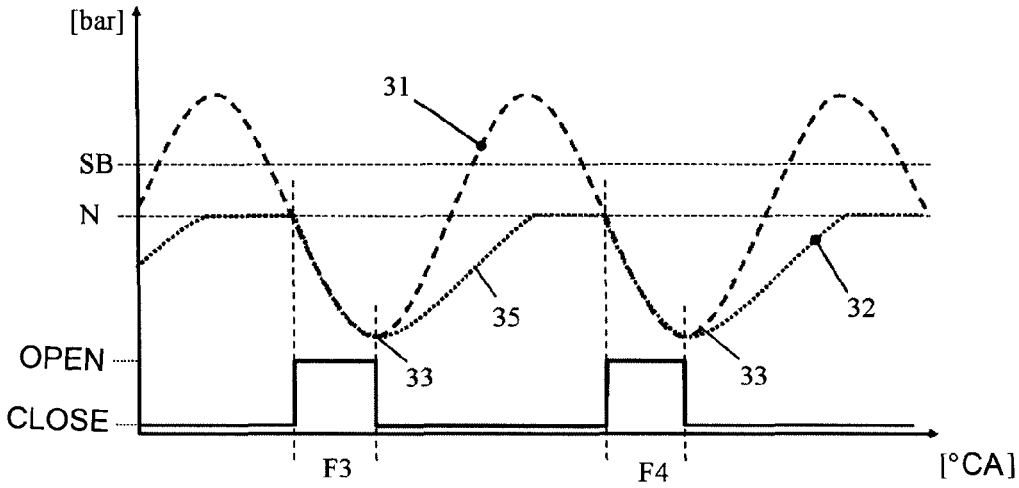
FIG. 3 shows a pressure course according to FIG. 2 in a second phase of priming.

After long downtimes or operational interruptions, it may happen that air penetrates into the fuel metering device 27, i.e., into the supply conduits or into the pump chamber 22 and impairs proper function of the fuel metering device 27. In order to ensure for a disturbance-free operation a complete priming of the fuel metering system 27 a start control device 30 is provided that, in the starting phase of the internal combustion engine 1 keeps open the metering valve 20 independent of the calculated control timing of the control unit 21. This start control device 30 controls priming durations F1, F2, F3, F4 as illustrated in FIGS. 2 and 3. With reference to FIG. 2, the pressure course is plotted against the crank angle. The pressure course 31 represents the alternating operating pressure in the metering chamber 15 into which the metering valve 20 opens. In the illustrated embodiment, the metering chamber 15 corresponds to the interior of the crankcase 4.

When the metering valve 20 opens into a transfer passage, the volume of the transfer passage forms the metering chamber. When the metering valve is arranged in the intake passage, the metering chamber is the interior of the intake passage. An underpressure of up to approximately −300 mbar can be present in the metering chamber.

The pressure course 31 is represented in idealized form and fluctuates about a normal pressure N, for example, the ambient or atmospheric pressure. In order to operate without interruption, the fuel metering device 27 requires an operating pressure SB in the range of 0.1 bar to 1 bar in the fuel system.

In the starting phase of an internal combustion engine the start control device will keep open the metering valve 20 for a priming duration F1, F2, F3, F4 so that the negative operating pressure of, for example, −300 mbar, in the metering chamber 15 that exists at the mouth of the metering valve 20 will suck in fuel through the fuel metering device 27 and therefore will prime the fuel metering device 27.

Figure 5:
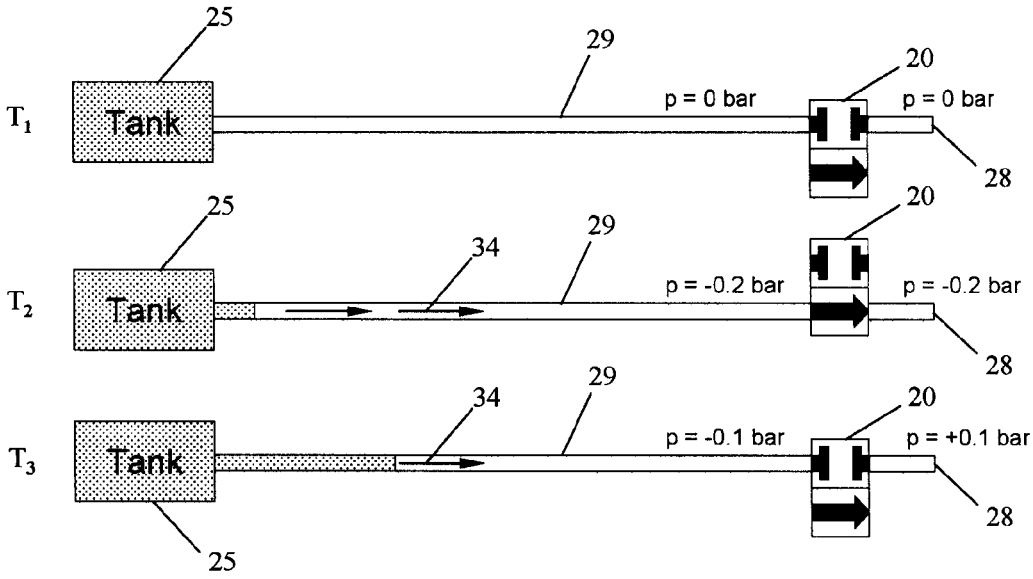
FIG. 5 is a schematic illustration of priming of the fuel metering device.

As illustrated in FIG. 5, at the point in time T1 the fuel conduit 29 and/or the pump chamber 22 of the fuel pump 17 are empty. Fuel is located essentially in the tank 25. The metering valve 20 is blocked. The system pressure in the fuel metering device 27 as well as the operating pressure at the mouth 28 of the metering valve 20 correspond to normal pressure, i.e., approximately 0 bar and are thus below a desired target pressure that may correspond to the operating pressure. By turning the crankshaft 7—which can be done manually by a cable pull starter or by means of an electric starter—the reciprocating piston 5 will generate a crankcase pressure in the interior of the crankcase 4, i.e., in the metering chamber 15, that alternates in accordance with the pressure course 31 of FIG. 2. In this connection, at the time T1 the pressure in the fuel line 29 or the pump chamber 22 of the fuel pump 27 as well as at the mouth 28 of the metering valve 20 is zero.

When the operating pressure 31 at the mouth 28 of the metering valve 20 becomes negative, the metering valve 20 is opened by the start control device 30 for a priming duration F1. At this point in time, the system pressure that exists within the fuel supply line 29 to the metering valve 20 is approximately at ambient pressure.

The priming duration F1 is terminated when the operating pressure 31 of the metering chamber has a minimum 33 of, for example, −300 mbar. In the time period of the minimum of the operating pressure 31 the metering valve is closed, i.e., at the time T2. In FIG. 5, the time T2 at the moment of closing of the metering valve 20 is illustrated; in the fuel line 29 as well as at the mouth 28 of the metering valve 20 a negative pressure of e.g. −0.3 bar is present.

While the alternating operating pressure 31 in the metering chamber turns into the positive range, as a result of the closed metering valve 20 in the fuel conduit 29 there is still underpressure of −0.3 bar that—as a result of fuel being supplied in the flow direction 34 (FIG. 5)—is slowly reduced. This is represented in FIG. 2 in section 35.

As shown in FIG. 5 at the point in time T3, the afore applied negative pressure of the preceding priming duration is therefore still acting during positive pressure phases in the alternating operating pressure 31. The suction action for priming of the fuel metering device 27 as a result of the introduced underpressure therefore is maintained during the pressure course in the positive range of the alternating operating pressure 31.

When the conveying action of the diaphragm pump 17 illustrated in FIG. 1 begins, at the side of the metering valve 20 an underpressure of e.g. −300 mbar will act and at the side of the fuel pump 17 an increasing system pressure of e.g. 500 mbar. The fuel metering device 27 or its fuel supply line is therefore primed even faster as compared to the underpressure alone acting on the metering valve 20.

Advantageously, the start control device of the metering valve 20 will open only when the alternating operating pressure 31 in the metering chamber 15 is below the system pressure 32. This is the case at the end 36 of the section 35 of the system pressure characteristic line 32. Since at the time of opening of the metering valve 20 the operating pressure 31 already has dropped to the negative system pressure at the end 36, the priming duration F2 is smaller than the preceding priming duration F1. While the priming duration F1 last from the beginning of negative pressure course to the minimum 33 of the negative pressure course, the priming duration of F2 is shorter.

The more the fuel metering device 27 is primed, the faster the underpressure will be reduced after closing of the metering valve 20. The fuel is accelerated in the direction of arrow 34 in the fuel line 29 so that the underpressure can be completely eliminated until the occurrence of the next negative half wave. This has the result that the priming durations F3 and F4, as illustrated in FIG. 3, again last from the beginning of a negative pressure course to a minimum 33 of the pressure course 32, i.e., a maximum priming duration is provided. The quick reduction of the vacuum captured in the fuel line is even accelerated as the conveying action of the fuel pump 17 begins. The fuel column in the fuel metering device remains in motion, so that a faster priming action is ensured.

The system is primed more and more quickly from one crankshaft revolution to the next until the fuel pump 17, embodied expediently as a diaphragm pump, begins its operation and the system operating pressure SB in the fuel metering device 27 is built up at which pressure a proper function of the fuel metering device 27 is ensured.

Figure 4:
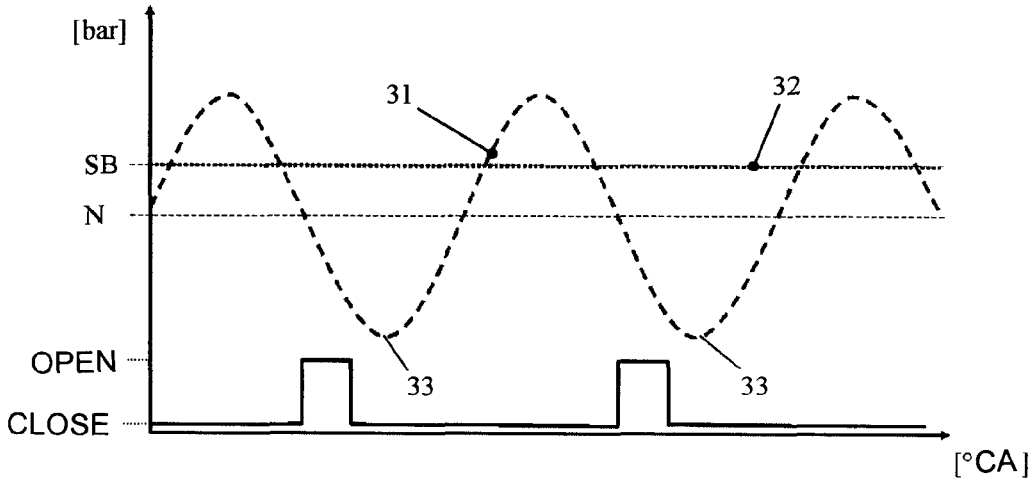
FIG. 4 shows a pressure course according to FIG. 2 showing the system pressure that is produced by the fuel pump after priming of the fuel metering device.

When the system is primed, the start control device is switched off; this can be done, for example, after a predetermined number of crankshaft revolutions or after detecting the pressure build-up by means of pressure sensor 40 that is arranged at the pressure side of the diaphragm pump. When the control unit 21 has determined that a satisfactory operating pressure is present the start control device 30 is switched off and, based on corresponding calculated control timing, the metering valve is operated for supplying the fuel quantity matched to a load situation of the internal combustion engine. By means of the system operating pressure in the fuel metering device 27 an injection across a wide operating range is possible; as shown in FIG. 4, an injection is always possible at a time when the operating pressure 31 in the metering chamber is smaller than the fuel system operating pressure.

The starting phase of the fuel metering device can be terminated upon reaching the desired target pressure; advantageously this is the fuel system pressure in the range of 0.1 bar to 1 bar. Independent of a detection of the fuel system pressure or monitoring of the target pressure, the starting phase can also be terminated based on a predetermined number of crankshaft revolutions. This criterion can be easily applied with existing means without additional sensors. For example, the number of crankshaft revolutions can be easily detected and, for example, after approximately 10 to 50 crankshaft revolutions, advantageously after approximately 25 crankshaft revolutions, the starting phase can be terminated. In a simple way, a termination of the starting phase of the fuel metering device is also possible after onset of combustion Whether a starting phase is required at all can be monitored by measuring a component temperature, for example, the cylinder temperature of the internal combustion engine. Above a limit temperature the starting phase of the fuel metering device is blocked because it can be assumed that as a result of the recent operating time the fuel metering device is still primed.

The specification incorporates by reference the entire disclosure of German priority document 10 2008 053 808.6 having a filing date of Oct. 29, 2008.

While specific embodiments of the invention have been shown and described in detail to illustrate the inventive principles, it will be understood that the invention may be embodied otherwise without departing from such principles.

What is claimed is:

1. A method for priming a fuel metering device for an internal combustion engine that comprises at least one piston arranged in a combustion chamber that drives by means of a connecting rod a crankshaft that is rotatably supported in a crankcase, further comprises a fuel pump that is a diaphragm pump driven by fluctuating pressure in the crankcase and that sucks in fuel from a fuel tank and conveys the fuel to a metering valve that opens into a metering chamber at alternating operating pressure, and further comprises a control unit that calculates and controls timing for the metering valve for metering a fuel quantity corresponding to a load situation of the internal combustion engine; the method comprising:

providing a start control device and, in a starting phase of the internal combustion engine, overriding with the start control device the timing calculated by the control unit and keeping open with the start control device the metering valve, independent of the timing for the metering valve calculated by the control unit, for a priming duration when the following conditions are fulfilled:

the alternating operating pressure of the metering chamber that exists at a mouth of the metering valve is negative; and a fuel system pressure in the fuel metering device is below a target pressure.

2. The method according to claim 1, comprising the step of opening the metering valve only when the alternating operating pressure of the metering chamber is below the fuel system pressure.

3. The method according to claim 1, comprising the step of closing in the starting phase the metering valve when the alternating operating pressure of the metering chamber has reached a minimum.

4. The method according to claim 1, comprising the step of defining the priming duration to last from the beginning of a negative pressure course to a minimum of the pressure course.

5. The method according to claim 1, wherein the alternating operating pressure of the metering chamber is the intake under pressure in the intake passage.

6. The method according to claim 1, wherein the alternating operating pressure of the metering chamber is the alternating crankcase inner pressure.

7. The method according to claim 1, comprising the step of determining the priming duration or an opening time and a closing time of the priming duration as a function of the crankshaft position of the crankshaft.

8. The method according to claim 1, comprising the step of terminating the starting phase of the fuel metering device after a predetermined number of crankshaft revolutions.

9. The method according to claim 8, wherein the number of crankshaft revolutions is between 10 and 50.

10. The method according to claim 9, wherein the number of crankshaft revolutions is approximately 25.

11. The method according to claim 1, comprising the step of terminating the starting phase of the fuel metering device after onset of combustion.

12. The method according to claim 1, comprising the step of blocking the starting phase of the fuel metering device above a limit temperature of the internal combustion engine or a component of the internal combustion engine.

* * * * *